US006864867B2

(12) United States Patent
Biebl

(10) Patent No.: US 6,864,867 B2
(45) Date of Patent: Mar. 8, 2005

(54) DRIVE CIRCUIT FOR AN LED ARRAY

(75) Inventor: Alois Biebl, Sankt Johann (DE)

(73) Assignee: Patent-Treuhand-Gesellschaft für elektrische Glühlampen mbH, München (DE)

( * ) Notice: Subject to any disclaimer, the term of this patent is extended or adjusted under 35 U.S.C. 154(b) by 306 days.

(21) Appl. No.: 10/074,121

(22) Filed: Feb. 12, 2002

(65) Prior Publication Data

US 2002/0140380 A1 Oct. 3, 2002

(30) Foreign Application Priority Data

Mar. 28, 2001 (DE) ..... 101 15 388

(51) Int. Cl.[7] ..... G09G 3/32
(52) U.S. Cl. ..... 345/82
(58) Field of Search ..... 345/82, 211; 315/291, 315/159, 76, 179; 358/296; 347/237; 362/119

(56) References Cited

U.S. PATENT DOCUMENTS 4,706,130 A * 11/1987 Yamakawa ..... 358/296
5,309,151 A * 5/1994 Aoki ..... 345/211
5,453,663 A * 9/1995 Nakayama ..... 315/159
5,634,711 A * 6/1997 Kennedy et al. ..... 362/119
5,936,599 A * 8/1999 Reymond ..... 345/82
6,153,985 A * 11/2000 Grossman ..... 315/291
6,400,101 B1 * 6/2002 Biebl et al. ..... 315/291
6,433,483 B1 * 8/2002 Michael et al. ..... 315/76
6,515,434 B1 * 2/2003 Biebl ..... 315/291
6,535,235 B1 * 3/2003 Nagumo ..... 347/237
6,636,003 B2 * 10/2003 Rahm et al. ..... 315/179
2001/0038268 A1 * 11/2001 Fuchsberger et al. ..... 315/291

FOREIGN PATENT DOCUMENTS

DE 19734750 A1 2/1999
DE 19749333 A1 3/1999
DE 19930174 A1 1/2001
DE 19550135 A1 4/2001

* cited by examiner

*Primary Examiner*—Vijay Shankar
*Assistant Examiner*—Prabodhm Dharia
(74) *Attorney, Agent, or Firm*—Cohen, Pontani, Lieberman & Pavane

(57) ABSTRACT

A drive circuit for an LED array comprises a first LED cluster and at least one second LED cluster. A control loop is designed to drive a switch of the first LED cluster so as to achieve a constant mean value of the current ($I_{LED}$) flowing through the first LED cluster the control loop being designed for also driving switches of the further LED clusters. The drive circuit also comprises a total current detection device ($R_{MES}$) with the aid of which it is possible to determine an actual magnitude ($U_{Mess}$) which corresponds to the sum of the currents through at least two of the second LED cluster. A comparison unit compares the actual magnitude ($U_{Mess}$) with a predefinable desired magnitude ($U_{OL}$)

18 Claims, 6 Drawing Sheets

DRIVE CIRCUIT FOR AN LED ARRAY

FIELD OF THE INVENTION

The present invention relates to a drive circuit for an LED array which comprises a first LED cluster and at least one second LED cluster, a switch being arranged in series with each LED cluster, and each LED cluster having a supply terminal via which it can be connected to a supply voltage, it being possible to drive each switch so as to permit a current flow in the associated LED cluster, having a control loop which is designed to drive the switch of the first LED cluster so as to achieve a constant mean value of the current flowing through the first LED cluster, the control loop being designed to drive at least one switch of a second LED cluster. It relates, moreover, to a method for operating an LED array which comprises a first LED cluster and at least one second LED cluster, a switch being arranged in series with each LED cluster, and each LED cluster having a supply terminal via which it can be connected to a supply voltage.

BACKGROUND OF THE INVENTION

The invention is concerned with driving LEDs. It is normal for this purpose to use series resistors or current sources which limit and/or control the current through the LED. The LEDs are generally interconnected to form a cluster, that is to say a cluster comprises a series circuit of a plurality of LEDs. A plurality of LED clusters must be connected in parallel, that is to say be combined to form an array, depending on the size of the area to be lit or backlit. There is the basic problem here that a status terminal of the drive circuit is intended to supply a corresponding indication as soon as a fault has occurred in one or more LED clusters.

A first solution to this problem that is known from the prior art and comes from ST Microelectronics AG consists in interconnecting the entire LED array to form a single LED cluster. It is disadvantageous in this solution that such an LED cluster requires a substantially higher supply voltage in order to reach the LED cluster voltage, that is to say the sum of all the LED forward voltages. As soon as a fault occurs, the complete LED array is de-energized, that is to say it no longer shines.

A second solution that is known from the prior art and comes from Infineon Technologies AG consists in controlling and monitoring each individual LED cluster using a dedicated LED drive block. Since an LED array usually consists of a plurality of LED clusters, this invention is attended by the disadvantage that a plurality of LED driver blocks are required therefor. All the LED driver blocks are connected together to a single status terminal, and so it cannot be determined exactly how many LED clusters have failed. The use of a plurality of LED driver blocks is not desired, since this has a disadvantageous effect on the costs.

A further solution to the above problem, which is known from the prior art, is provided by the applicant of the present invention (DE19930174; Biebl) and functions as follows:

firstly, the principle of pulsed current control is explained with reference to FIG. 1 a series circuit of a plurality of LEDs, D1 to D4, is connected, on the one hand, to a supply voltage $U_{Batt}$ via a switch S1, and on the other hand to frame via a measuring shunt $R_{Shunt}$. The voltage $U_{Shunt}$ dropping across the resistor is fed to an integrator 10 which provides at its output a mean value of the voltage present at the input. This voltage is fed to a controller 12 which also receives as input signal a reference voltage $U_{Ref}$ which corresponds to a mean desired value of the current $I_{Led}$ through the LEDs, D1 to D4. The control voltage $U_{Regel}$ provided by the controller 12 at its output is supplied to the positive input of a comparator 14, there being present at its negative input a delta voltage $U_D$ which is provided by a triangle generator 16. The output signal of the comparator 14 is used to drive the switch S1. As emerges from the graph in the right-hand half of FIG. 1, the signal driving the switch S1 is a pulsed signal, recognizable from the squarewave function of the LED current $I_{LED}$. This arrangement ensures that the current $I_{LED}$ flowing through the LEDs is controlled to a value correlated with the voltage $U_{Ref}$.

Shown schematically and by way of example in the right-hand half of FIG. 2 are three such circuits, illustrated in FIG. 1, with pulsed current control, specifically the blocks 18, 20, 22. The supply voltage, the individual LEDs and, likewise, the resistors $R_{Shunt}$ are omitted for reasons of clarity. If each of the blocks 18, 20, 22 comprises an LED cluster, an LED array can be realized by such an interconnection. A triangle generator 24 applies a clock signal 26 to a counter 28 which is applied to a multiplexer 30. The clock signal causes the multiplexer 30 to sample the control voltages of the three blocks 18, 20, 22 sequentially and feed them to a fault detection logic circuit with a comparator 32 and a flip-flop 34. As soon as one of the control voltages $U_{Regel\ 1}$, $U_{Regel\ 2}$, $U_{Regel\ 3}$ is lower than a prescribed threshold-value voltage $U_{SW}$, the comparator 32 generates a signal to the flip-flop 34 so as to generate at the Q output of the flip-flop 34 a signal which indicates a fault in one of the LED clusters of the blocks 18 to 22. Here, only the blocks 18 to 22 are mentioned by way of example, it being possible, of course, as indicated by the lines of dashes, for further blocks to be part of the same LED array.

The problem with this solution is, firstly, the additional outlay for a counter 28 and a multiplexer 30 and, on the other hand, the fact that a plurality of LED driver blocks are required in the case of larger LED arrays, since the number of current control loops per LED driver block is limited, for example to eight. The use of a plurality of LED driver blocks is reflected, in turn, disadvantageously in the price.

In addition to the disadvantages mentioned, in the case of the solutions addressed there is a further disadvantage that a fault signal is output immediately as soon as a fault has occurred. This is necessary, however, only if, as in the case of the first named solution, the complete LED cluster has failed. With regard to specific fields of application of LED arrays, for example in the vehicle sector as taillights, this would again justify the use of an incandescent bulb. In the case of an incandescent bulb, there also exists only two states of incandescent bulb intact and incandescent bulb not intact. The advantage of using LEDs in this sector resides, however, in the fact that in the event of failure of an LED cluster the light is capable of continuing to be operated if sufficient other functioning LED clusters are still present—although with somewhat diminished luminance—but, if suitably dimensioned, still above a limiting value prescribed by statute.

SUMMARY OF THE INVENTION

One object of the present invention is to provide a drive circuit for an LED array that ensures continuing operation of the LED array with a cost-effective implementation if the entire luminance of the LED array lies above a prescribable value.

This and other objects are attained by a drive circuit having the features of patent claim 1, and by a method for operating an LED array having the features of patent claim 17.

The point of departure is a patent application of the present applicant entitled "Ansteuerschaltung fur LED und zugehöriges Betriebsverfahren" ["Drive circuit for LEDs and associated method of operation"] (application No. DE19950135.1; Biebl), in the case of which a plurality of LED clusters are operated in a cascade arrangement. In this case, a higher-level LED cluster is denoted as master cluster, and its average current is fed to a control loop, the drive signal of the master cluster also being used to drive a plurality of lower-level LED clusters, what are termed slave clusters. Starting from the teaching of the application just mentioned, the above object of the invention can be achieved when the total current through all the slave clusters is measured and this current is compared against a prescribable desired value. No fault message is generated as long as the total current lies above the threshold value despite failure of individual slave clusters. A fault signal is not generated until the prescribed threshold value is undershot, which is the same as saying, for example, that the diminished luminance now no longer corresponds to the statutory stipulations.

This realization offers the advantage that the entire LED array can be operated despite failure of individual LED clusters, that the fault detection logic circuit can be kept very simple, in particular need be provided only once, and, finally, that the LED array with an arbitrary number of LED clusters can be monitored by the fault detection device. The only limiting factor is the driver for generating the drive signal for the switch of each LED cluster.

In a particularly preferred embodiment, the desired magnitude can be set by a user. A user is able by means of this measure to determine himself how many LED clusters may fail before the fault signal is generated and thereby informs the user of a failure. Furthermore, the comparison unit is preferably to be designed to output an information signal in the event of undershooting of the desired magnitude by the actual magnitude. This information signal can then also be used, for example, for the purpose of informing a user to switch over to another array, etc.

Furthermore, the drive circuit according to the invention preferably comprises a monitoring unit with which the current flow through the first LED cluster can be monitored. This is particularly advantageous because, after all, the slave clusters are also driven with regard to what is termed the master cluster. Specifically, the current flow through the master cluster serves as input signal of the control loop, which also drives the slave clusters. In the event of failure of the master cluster, the risk would therefore exist that all the slave clusters would also be destroyed by being driven incorrectly. On the other hand, in the event of a fault having been detected as occurring in the master cluster, it is possible to switch over to a standby control loop, for example, to a control loop provided for a slave cluster, so that this slave cluster can then become the master cluster.

The monitoring unit is therefore preferably designed in such a way that the control loop is disconnected when a current flow which is outside a prescribable tolerance range, for example in the event of no current flow at all, is determined in the first LED cluster.

The drive circuit also preferably comprises an undervoltage detection device which is designed to output an undervoltage warning signal when the supply voltage falls below a prescribable value. Specifically, uncontrolled processes can result when the supply voltage of the circuit, the vehicle voltage in an automobile, for example, approaches the cluster voltage of the LEDs, that is to say the sum of all the LED forward voltages. In particular, the prescribed desired magnitude can be unintentionally modified such that the comparison unit wrongly outputs an information signal. This is preferably achieved by virtue of the fact that the supply voltage is compared with a reference voltage which is preferably equal to or greater than the sum of the forward voltages through all the LEDs of a cluster. As long as the supply voltage is higher than the reference voltage, no undervoltage warning signal is output. This measure permits the drive circuit to remain active in the event of noncritical drops in the supply voltage.

The drive circuit is preferably designed such that this prescribable value can also be set manually or prescribed permanently.

In accordance with the particularly preferred exemplary embodiment, the drive circuit further comprises an output unit to which the information signal and/or the undervoltage warning signal can be transmitted. This opens up the possibility that in the event of receipt of the information signal the output unit relays the latter, for example makes it available as fault signal to a user, only when no undervoltage warning signal has been transmitted.

The output unit is therefore preferably designed such that in the event of receipt of the undervoltage warning signal it deactivates itself for a predetermined time or for the duration of reception of the undervoltage warning signal such that during a time interval in the course of which the supply voltage has dropped below a critical value, the output unit does not produce any incorrect results.

The output unit preferably has at least one transistor which is located in an open collector circuit and whose base is connected to the comparison unit for the purpose of transmitting the information signal, and/or is connected to the undervoltage detection device for the purpose of transmitting the undervoltage warning signal. An open collector circuit offers the advantage that the collector of the transistor is drawn to frame upon the occurrence of the information signal and/or the undervoltage detection signal. The signal present at the collector can in this way be connected simply to any desired realizations of a fault evaluation circuit. For example, this opens up the possibility of interconnecting other output units, which are likewise realized in an open collector circuit, via the respective collectors. As soon as a collector is drawn to frame, that is to say a signal which switches the respective transistor into the conductive state, is present at the base of the transistor, a common display can be activated for all the output units.

In a particularly preferred exemplary embodiment of the invention, the drive circuit further comprises a closing delay device which is designed to deactivate the output unit for a predetermined time after the closure of the drive circuit. Such a closing delay device acts advantageously against uncontrolled switching processes which are associated with the closure, chiefly inside the control loop.

The output unit can comprise a flip-flop, it being possible to connect the base of the transistor to the output of the flip-flop, and the set input of the flip flop to the undervoltage detection device in order to transmit the undervoltage warning signal, and/or to connect it to the comparison unit in order to transmit the information signal. The use of a flip-flop prevents a sporadic fault signal, for example in the case of contact problems. That is to say, once set, a fault signal is retained as long as the drive circuit is closed, that it to say activated.

It is particularly advantageous in this context when the closing delay device is designed to apply a closing delay signal to the reset input of the flip-flop of the output unit over the duration of the closing delay. It is possible very simply in this way also to use the flip-flop for the purpose of preventing an output of a fault signal via the output unit during a predetermined time interval after the closure of the drive circuit.

The drive circuit according to the invention is not limited only to the clocked operation of the LED drive, but is just as suitable for a DC operation of LEDs. Determined in the first case mentioned as actual magnitude is a mean value of the sum of the currents through at least two, in particular through all of the second LED clusters, in order to make a comparison against the desired magnitude.

The above object is also achieved by a method for operating an LED array which comprises a first LED cluster and at least one second LED cluster, a switch being arranged in series with each LED cluster, and each LED cluster having a supply terminal via which it can be connected to a supply voltage. In this method, the switch of the first LED cluster is driven with a drive signal so as to achieve a constant mean value of the current flowing through the first LED cluster, at least one second LED cluster being driven with the same drive signal. The sum of the currents through at least two, in particular through all of the second LED clusters is measured as actual magnitude, the actual magnitude subsequently being compared with a prescribable desired magnitude.

BRIEF DESCRIPTION OF THE DRAWINGS

Further advantageous embodiments are defined in the subclaims. Exemplary embodiments of the invention are described below in more detail with reference to the attached drawings, in which:

DETAILED DESCRIPTION OF THE DRAWINGS

Identical reference symbols are used throughout below for identical and equivalent elements of the various exemplary embodiments.

Figure 1:
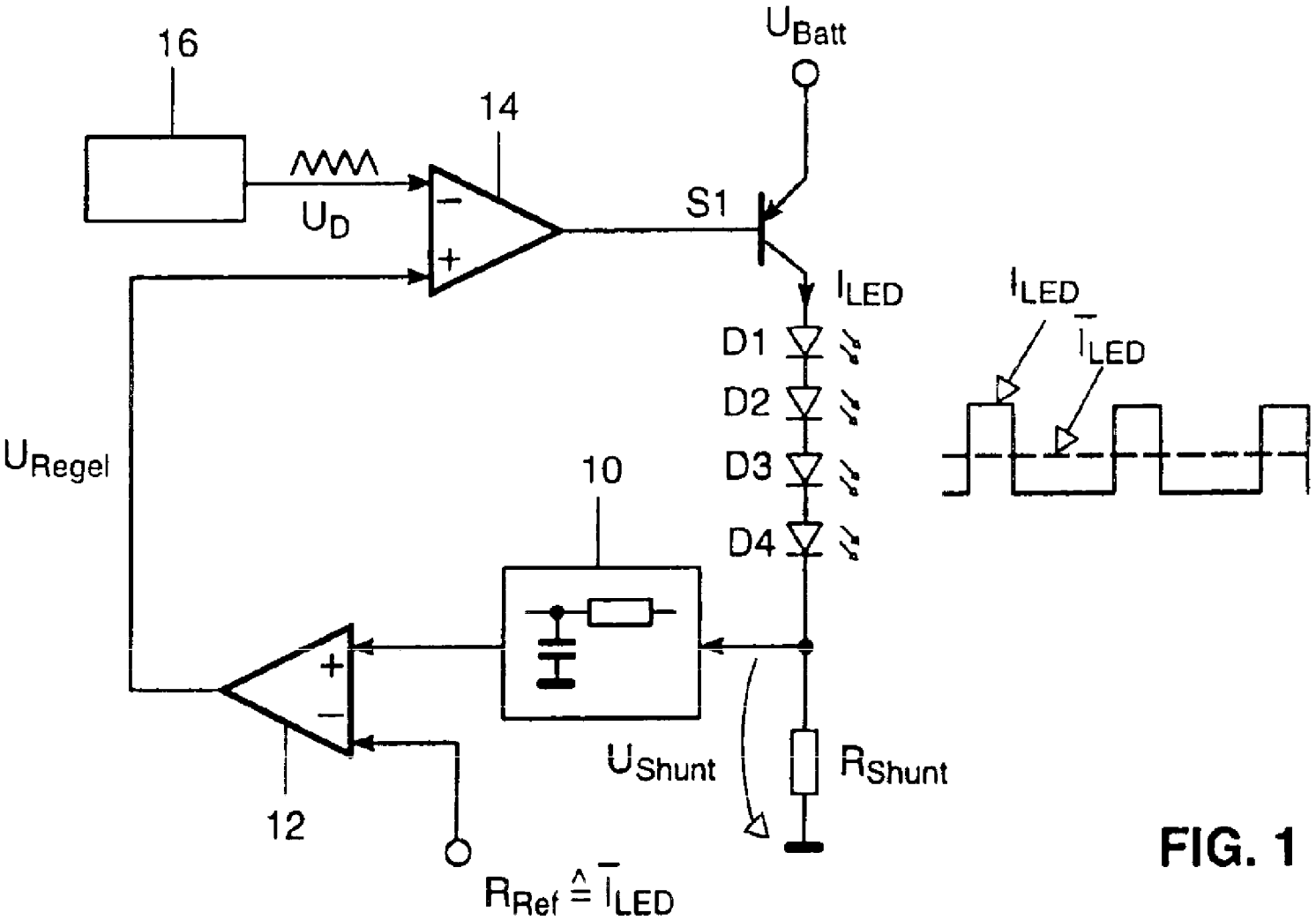
FIG. 1 illustrates a circuit arrangement, known from the prior art, for driving an LED cluster with pulsed current control.
Figure 2:
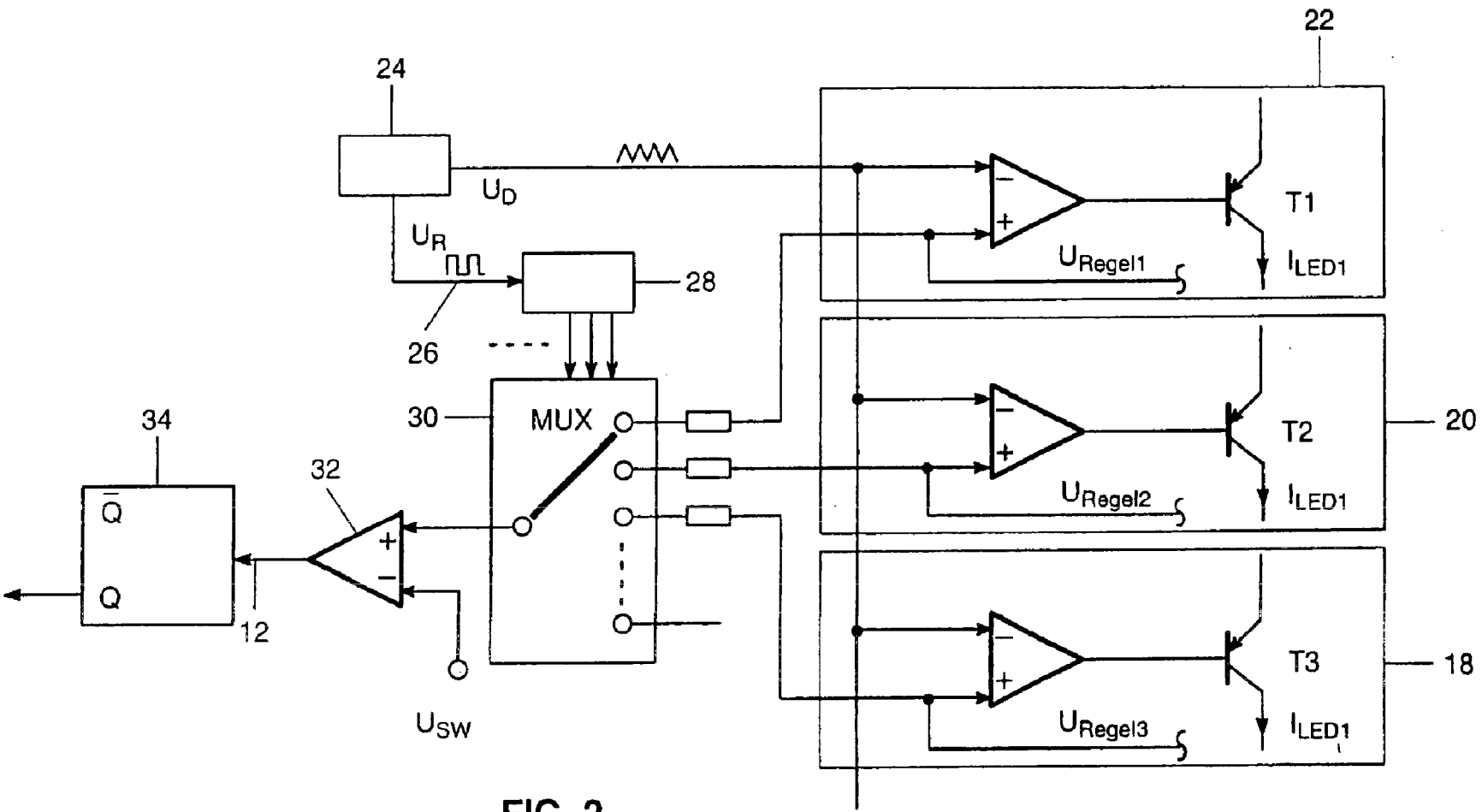
FIG. 2 illustrates a drive circuit, known from the prior art, for a plurality of LED clusters with a multiplexer.
Figure 3:
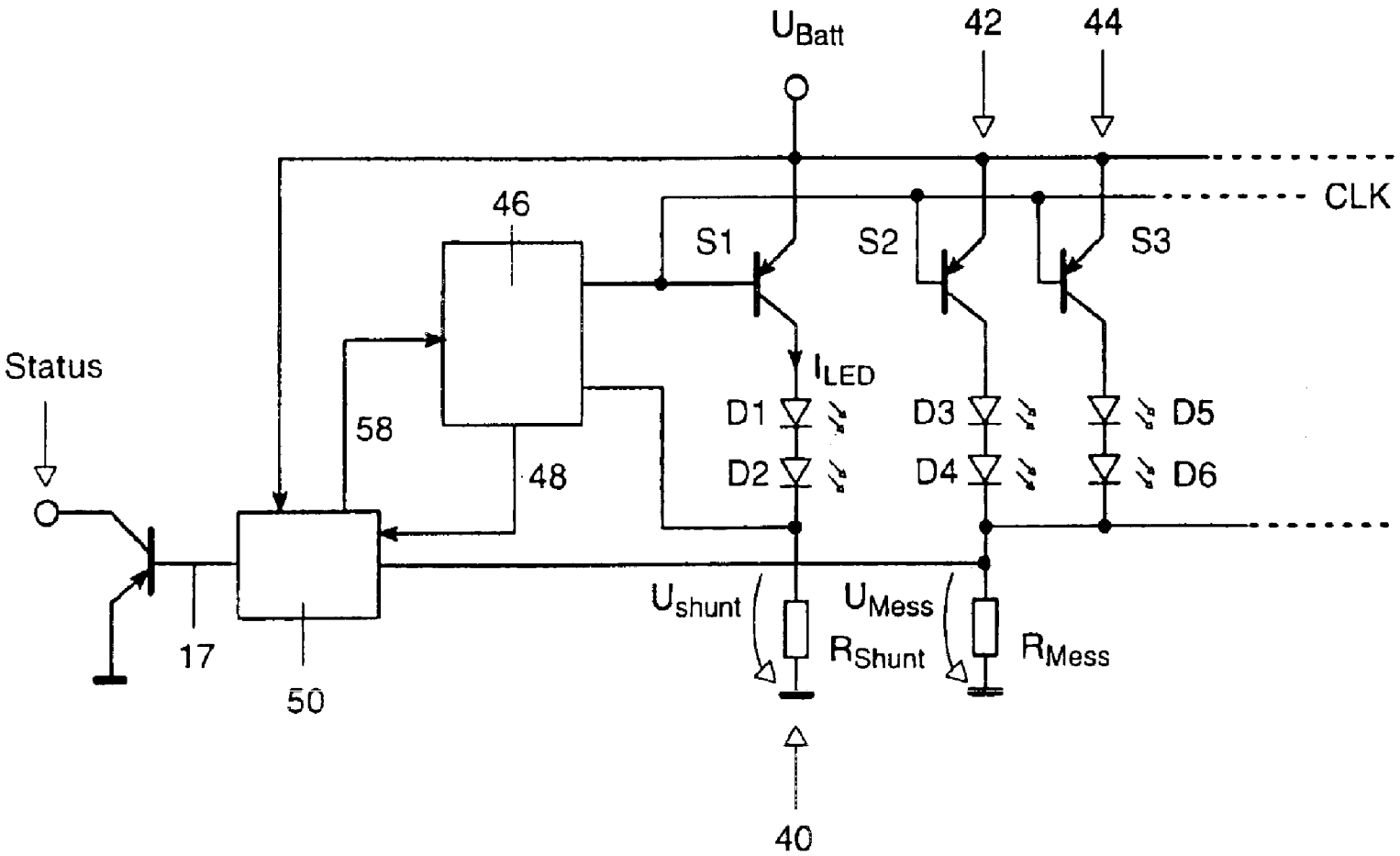
FIG. 3 illustrates a first exemplary embodiment of a drive circuit according to the invention with detection of the total current of the slave clusters.

In the drive circuit illustrated in FIG. 3, a first LED cluster 40 with two LEDs D1, D2 is denoted as master cluster. A plurality of second LED clusters 42, 44 with LEDs D3, D4, D5, D6 are denoted as slave clusters. Of course, a multiplicity of LEDs can be arranged per cluster instead of the two LEDs shown by way of example. This is limited essentially by whether the battery voltage $U_{Batt}$ used for the supply suffices in order to apply the sum of the LED forward voltages.

The current flow through the master cluster 40 is detected by means of a resistor $R_{Shunt}$, the voltage $U_{Shunt}$ dropping across the resistor $R_{Shunt}$ being fed to an LED drive circuit 46. The latter supplies the drive clock pulse CLK for the switch S1 of the master cluster 40, as well as for the switches S2, S3 of the slave clusters 42 and 44. The total current through the slave clusters is determined via a resistor $R_{Mess}$, the voltage $U_{Mess}$ dropping across the resistor $R_{Mess}$ being fed to the diagnosis unit 50. The latter continues to receive the battery voltage $U_{Batt}$ as well as a signal 48 fed by the LED drive unit 46. The diagnosis unit 50 for its part supplies a signal 58 to the LED drive unit 46. The signals 48 and 58 are described further below in yet more detail, as is the design of the diagnosis unit 50. The output signal of the diagnosis unit 50 is applied to the base of a status transistor ST1 in an open collector circuit. An item of information on the status of the LED array is provided at a collector of the transistor ST1.

Figures 4A, 4B:
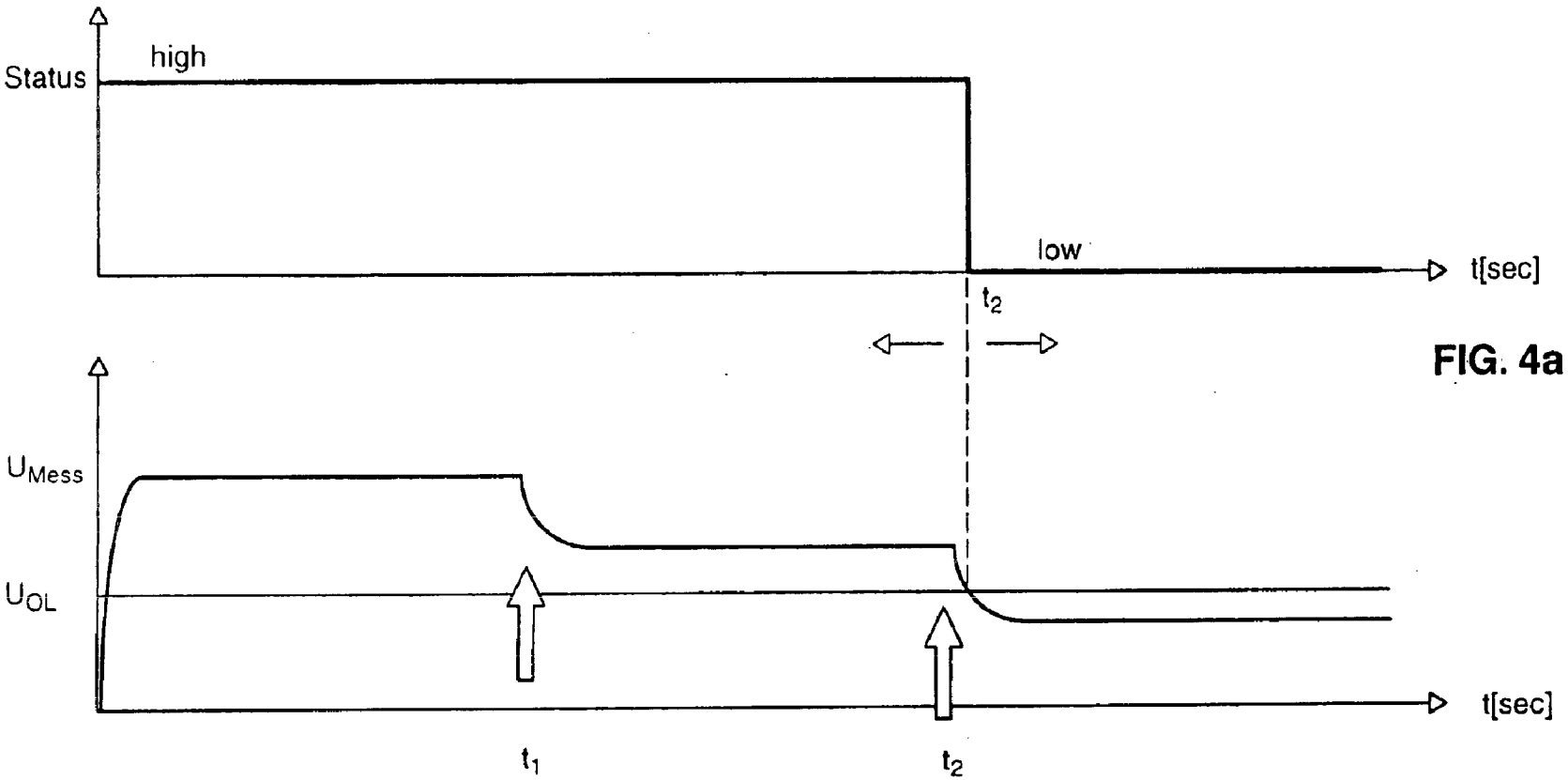
FIG. 4*a* illustrates the characteristic of the fault signal in the event of occurrence of a fault of decisive importance.
FIG. 4*b* illustrates the time characteristic of the voltage $U_{Mess}$ in the event of failure of individual LED clusters in the exemplary embodiment of FIG. 3.

FIG. 4*b* shows the time characteristic of the voltage $U_{Mess}$ dropping across the resistor $R_{Mess}$, Also plotted is a voltage $U_{OL}$ defined by a user, which prescribes a desired value against which $U_{Mess}$ is compared. The failure, taking place at the instant t1, of a first slave cluster exerts no influence, since the voltage $U_{Mess}$ is higher than $U_{OL}$ even after this failure. It is the failure of a second slave cluster at the instant t2 which is the first to cause $U_{Mess}$ to undershoot the voltage $U_{OL}$, and this leads to the generation of an information signal 47, see FIG. 4*a*. The status signal at the collector of the status transistor ST1 does not go from high to low until the failure of the second slave cluster at the instant t2, that is to say at the instant at which $U_{Mess}$ undershoots $U_{OL}$.

Figure 5:
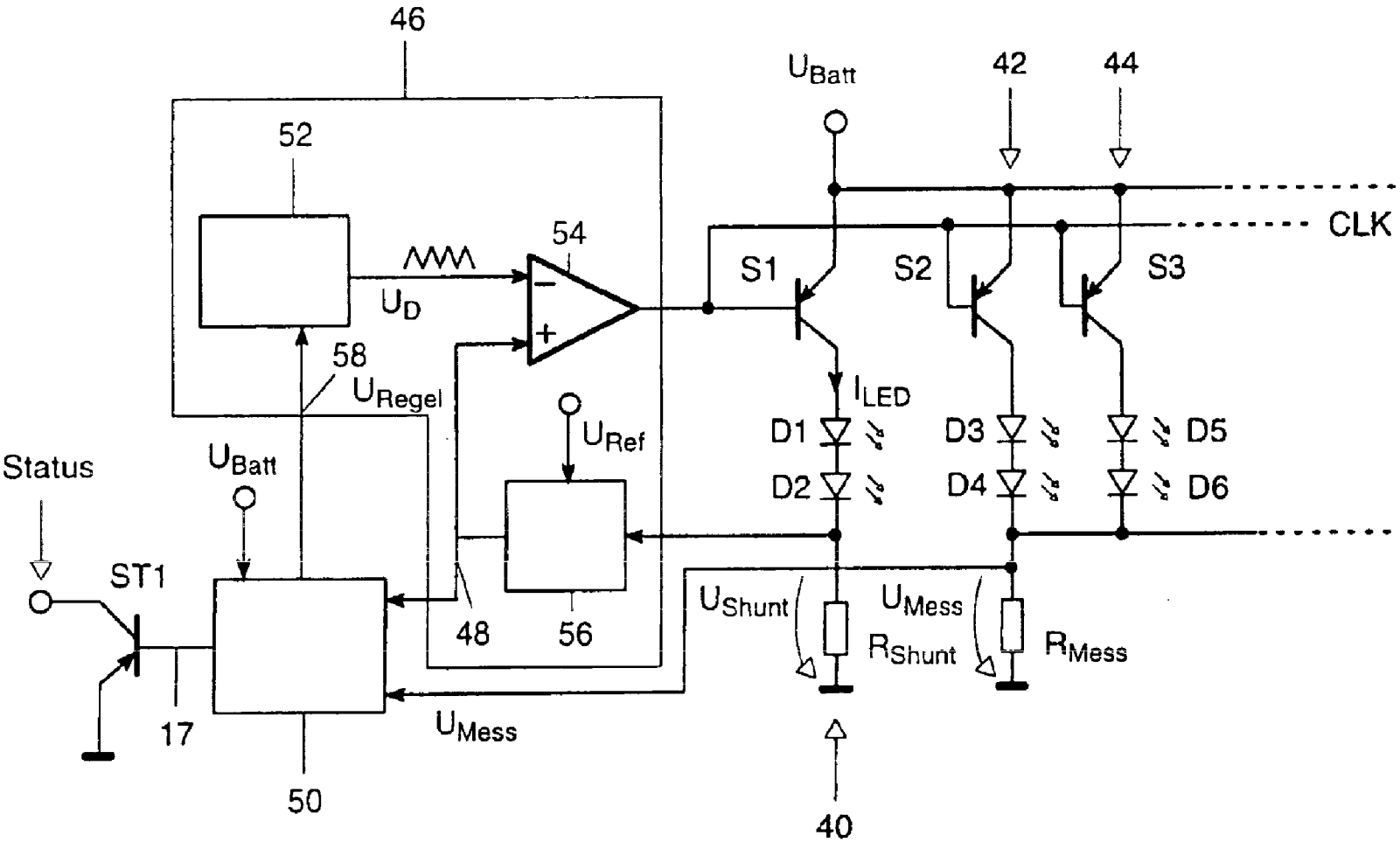
FIG. 5 shows a detailed illustration of the embodiment of FIG. 3.

The LED drive unit 46 and the diagnosis unit 50 of FIG. 3 are illustrated in more detail in FIG. 5. A triangle generator 52 supplies a triangular signal $U_D$ to the negative input of a comparator 54. As input variable, a control unit 56 receives, on the one hand, the voltage $U_{Shunt}$ dropping across the resistor $R_{Shunt}$, as well as a reference voltage $U_{Ref}$ with which the mean value of the current $I_{LED}$ through the LEDs of the master cluster 40 is set. Since the switch S1 is designed in this case as PNP transistor and the delta voltage $U_D$ is fed to the comparator 54 at the negative input thereof, in the case when the current $I_{LED}$ through the master cluster is too low the controller 56 generates a lower control voltage $U_{Regel}$ at its output. The controller 56 increases the voltage $U_{Regel}$ in the case when the current $I_{LED}$ is too high. In the case of a fault in the master cluster 40 which prevents a current flow $I_{LED}$ through the master cluster 40, $U_{Regel}$ would therefore become very low and the consequence of this would be that the switches S2, S3 of the slave clusters 42, 44 would be driven by the comparator 54 in such a way that they would open fully. The result of this would be that the slave LED clusters D3, D4, D5, D6 would be at the full supply potential $U_{Batt}$, and this could result in destruction of the LEDs. In order for this not to occur, the voltage $U_{Regel}$ is fed as signal 48 to the diagnosis unit 50 which is designed in such a way that a drop in $U_{Regel}$ below a prescribable threshold value is recorded and switches off the triangle generator 52 via a connection 58.

Figure 6:
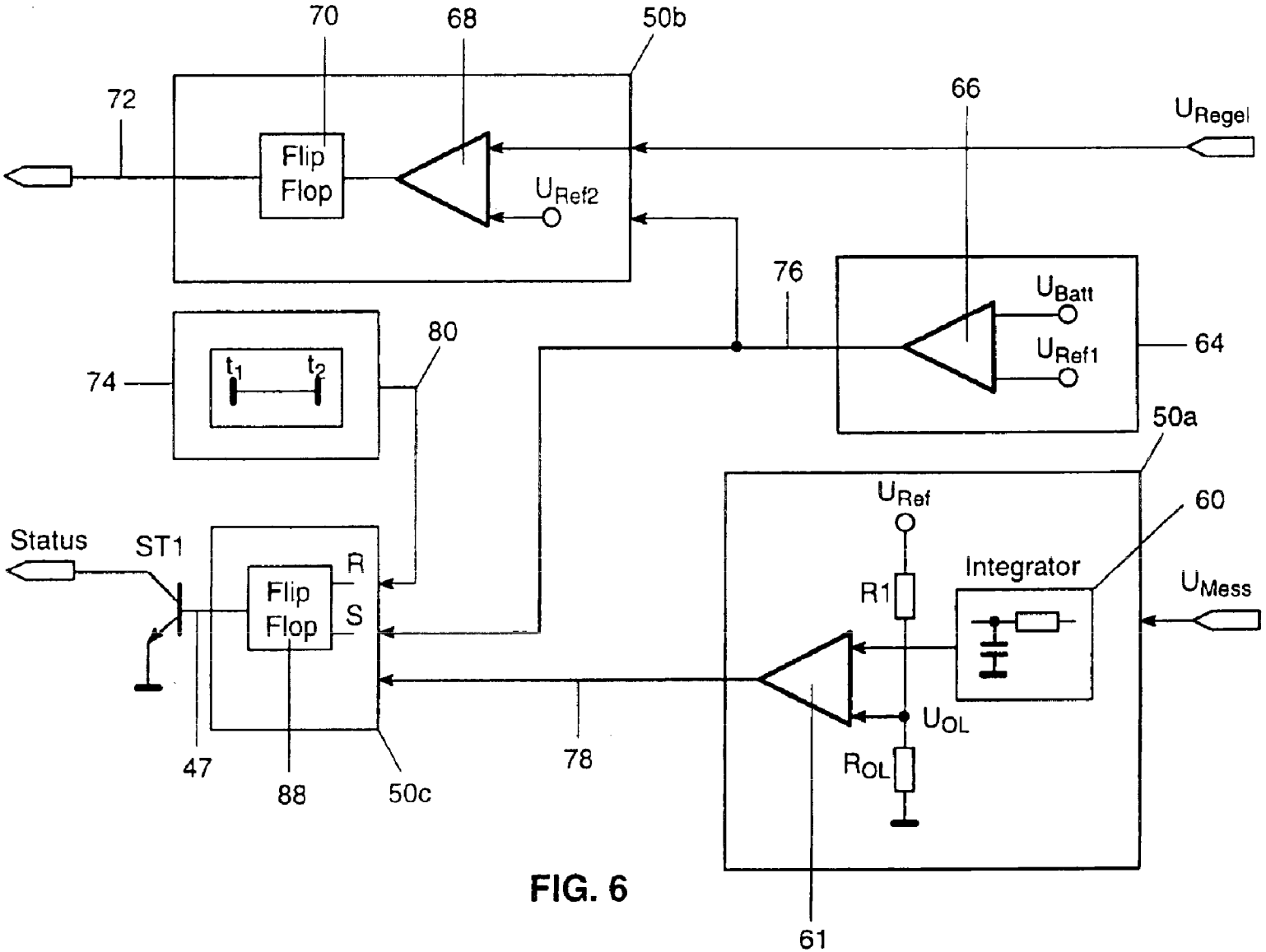
FIG. 6 shows a schematic illustration of a block diagram of an embodiment of the fault diagnosis for a drive circuit according to the invention.

In addition to the already mentioned safety measures, FIG. 6 shows in a schematic illustration a general view of two further ones which can be realized in the drive circuit according to the invention. The diagnosis unit 50 is separated into a block 50*a*, a block 50*b* and a block 50*c* in order to separate the individual functions. The voltage $U_{Mess}$ dropping across the resistor $R_{Mess}$ is integrated in an integrator 60 in the block 50*a*, that is to say the mean value is formed, and the output signal of the integrator 60 is fed to a comparator 62. The comparator 62 receives at its other input the voltage $U_{OL}$ obtained by a voltage divider, which comprises the resistors R1 and $R_{OL}$, from the voltage $U_{Ref}$. The comparator 62 provides the signal 78 at its output.

A block 64 serves to detect undervoltages. Specifically, as soon as the supply voltage $U_{Batt}$ of the circuit approaches the cluster voltage of the LEDs, that is to say the sum of all the LED forward voltages, uncontrolled processes can occur during the fault diagnosis. For this purpose, the supply voltage $U_{Batt}$ is compared in a comparator 56 against a reference voltage $U_{Ref1}$. Fixing the voltage $U_{Ref1}$, that is to say the undervoltage limit, can be performed by a voltage divider which is preferably located completely outside the undervoltage detection unit 64. Alternatively, the voltage divider can be realized by locating a resistor in the circuit and an adjustable resistor outside. The voltage $U_{Ref1}$ can then be set by a user via the external resistor. However, it is also possible to provide, for example when applying the drive circuit in the automobile sector, where the overvoltage limit is prescribed (this being 9 V in the 14 V/12 V vehicle network, and 30 V in the 42 V vehicle network), for the capability for manual setting to be dispensed with in order to save costs, and for $U_{Ref}$ to be fixed with regard to the vehicle network voltage. The undervoltage detection unit provides a signal 76 at its output. The control voltage $U_{Regel}$ is fed to the block 50*b* and compared in a comparator 68 against the reference voltage $U_{Ref2}$. If the voltage $U_{Regel}$ is lower than the voltage $U_{Ref2}$, the comparator 68 supplies a signal to a flip-flop 70 whose output signal 72 can, for the purpose of preventing a destruction of the LEDs in the slave clusters, be used to disconnect the entire drive circuit, or to trigger a master switchover in the case of which a slave cluster is made into the master cluster. The block 50*b* is also fed the signal 76 of the undervoltage detection unit 64 in order to prevent erroneous generation of the output signal 72 in the case when the supply voltage $U_{Batt}$ has dropped too far. The reason for this is that the reference voltage $U_{Ref2}$ is frequently obtained from the supply voltage $U_{Batt}$ and a comparison with the voltage $U_{Regel}$ could lead to incorrect results in the event of occurrence of an undervoltage.

A closing delay for the drive circuit is realized with the arrangement in block 74 in order to prevent uncontrolled switching operations in conjunction with closing the drive circuit. It generates a signal 80 at its output.

Just like the output signal 78 of the block 50*a*, and the output signal 80 of the closing delay circuit 74, signal 76 is fed to the block 50*c*, which drives the status transistor ST1. It is ensured in block 50*c* that a signal to the status transistor is generated only when the drive circuit is not in a predetermined time interval after the closure, if no undervoltage is present and, at the same time, the voltage $U_{Mess}$ is lower than $U_{OL}$. The block 50*c* comprises a flip-flop 88, the signal 76 and the signal 80 being applied in an OR'd fashion, to the reset input R of the flip-flop 88, while the signal 78 is applied to the set input S of the flip-flop 88. A sporadic fault signal in the event of possible contact problems is prevented by the use of the flip-flop 88. In the present case, once it has been set, a fault signal is retained as long as the drive circuit is connected. An enable input (not illustrated) can be provided for resetting a set fault signal.

What is claimed is:

1. A drive circuit for an LED array including a first LED cluster (40) and at least one second LED cluster (42; 44), comprising:

a switch (S1, S2, S3) arranged in series with each of the first and second LED clusters (40, 42, 44), and each of the first and second LED clusters (40, 42, 44) having a supply terminal via which it is coupled to a supply voltage ($U_{Batt}$), wherein said switch (S1, S2, S3) is adapted to be driven so as to permit a current flow in an LED cluster from among the first and second LED clusters that is associated therewith, a control loop (46) for driving the switch (S1) of the first LED cluster (40) S0 as to achieve a constant mean value of the current ($I_{LED}$) flowing through the first LED cluster (40), and the control loop (46) driving at least one switch (S2, S3) of a second LED cluster (42, 44), a total current detection device ($R_{Mess}$) for determining an actual magnitude ($U_{Mess}$) which corresponds to a sum of the currents through at least two of the second LED clusters (42, 44), and a comparison unit (50, 50*a*) for comparing the actual magnitude ($U_{Mess}$) with a prescribable desired magnitude ($U_{OL}$).

2. The drive circuit as claimed in claim 1, characterized in that the desired magnitude ($U_{OL}$) can be set by a user.

3. The drive circuit as claimed in claim 1, characterized in that the comparison unit (50, 50*a*) is designed to output an information signal (78) in the event of undershooting of the desired magnitude ($U_{OL}$) by the actual magnitude ($U_{Mess}$).

4. The drive circuit as claimed in claim 1, characterized in that it comprises a monitoring unit (50, 50*b*) with which the current flow through the first LED cluster (40) can be monitored.

5. The drive circuit as claimed in claim 4, characterized in that the monitoring unit (50, 50*b*) is designed in such a way that the control loop (46) is disconnected when a current flow which is outside a prescribable tolerance range is determined in the first LED cluster (40).

6. The drive circuit as claimed in claim 4, characterized in that the monitoring unit (50, 5*b*) is designed in such a way that the first LED cluster (40) is disconnected when a current flow which is outside a prescribable tolerance range is determined in the first LED cluster (40), and a second LED cluster (42, 44) is made relative to the first LED cluster.

7. The drive circuit as claimed in claim 1, characterized in that it also comprises an undervoltage detection device (64) which is designed to output an undervoltage warning signal (76) when the supply voltage ($U_{Ban}$) falls below a prescribable value ($U_{Ref1}$).

8. The drive circuit as claimed in claim 7, characterized in that the prescribable value ($U_{Ref1}$) is equal to or greater than the sum of the fox-ward voltages of all the LEDs of an LED cluster (40, 42, 44).

9. The drive circuit as claimed in claim 7, characterized in that the prescribable value ($U_{Ref1}$) can be set manually or can be prescribed permanently.

10. The drive circuit as claimed in claim 3, characterized in that it also comprises an output unit (50, 50*c*, ST1) to which the information signal (78) and/or the undervoltage warning signal (76) can be transmitted.

11. The drive circuit as claimed in claim 10, characterized in that the output (50, 50*c*, ST1) comprises at least one transistor (ST1) which is located in an open collector circuit and whose base is connected to the comparison unit (50*a*) for the purpose of transmitting the information signal (78), and/or is connected to the undervoltage detection device (64) for the purpose of transmitting the undervoltage warning signal (76).

12. The drive circuit as claimed in claim 1, characterized in that it also comprises a closing delay device (74) which is designed to deactivate the output unit (50, 50*c*, ST1) for a predetermined time after the closure of the drive circuit.

13. The drive circuit as claimed in claim 10, characterized in that the output unit (50, 50*c*, ST1) comprises a flip-flop (88), the base of the transistor (ST1) being connected to the output of the flip-flop (88), and the set input (S) of the flip-flop (88) being connected to the undervoltage detection device (64) in order to transmit the undervoltage warning signal (76), and/or being connected to the comparison unit (50*a*) in order to transmit the information signal (78).

14. The drive circuit as claimed in claim 12, characterized in that the closing delay device (74) is designed to apply a closing delay signal (80) to the reset input (R) of the flip-flop (88) of the output unit (50, 50*c*, ST1) over the duration of the closing delay.

15. The drive circuit as claimed in claim 1, characterized in that the actual magnitude ($U_{Mess}$) corresponds to a time average value of the sum of the currents through at least two, in particular through all of the second LED clusters (42,44).

16. A method for operating an LED array including a first LED cluster (40) and at least one second LED cluster (42, 44), comprising:

a switch (S1, S2, S3) arranged in series with each of the first and second LED clusters (40, 42, 44), and each of the first and second LED clusters (40, 42, 44) having a supply terminal via which it is coupled to a supply voltage ($U_{Ban}$), comprising a) driving a switch (51) of the first LED cluster (40) with a drive signal (CLK) to achieve a constant mean value of current ($I_{LED}$) flowing through the first LED cluster (40), and driving the at least one second LED cluster (42, 44) with the same drive signal (CLK);

b) measuring an actual magnitude ($U_{Mess}$) which corresponds to a sum of the currents through at least two of the second LED clusters (42, 44); and c) comparing the actual magnitude($U_{Mess}$) with a prescribable desired magnitude ($U_{OL}$).

17. A drive circuit for an LED array including a master LED cluster connected to a supply voltage and at least two slave LED clusters connected to the supply voltage, comprising:

a plurality of semiconductor switches arranged between the LED clusters and the supply voltage for allowing drive current to be supplied in a pulsed manner to each LED cluster;

a first current detection device for measuring a total master current $U_{Mess}$ between the master LED cluster and a ground;

a second current detection device for measuring a total combined slave current $R_{Mess}$ between the at least two slave LED clusters and the ground;

a control loop for controlling a master semiconductor switch in the master LED cluster such that a constant mean value of master LED current ($I_{LED}$) is achieved in the master LED cluster, the control loop also driving each semiconductor switch in the at least two slave LED clusters; and a diagnosis unit that compares a desired slave LED total current $U_{OL}$ the total combined slave current $R_{Mess}$ of the at least two slave clusters, and that produces an error signal if the total combined slave current $R_{Mess}$ of the at least two slave clusters falls below the desired slave LED total current $U_{OL}$.

18. The drive circuit as claimed in claim 17, wherein the desired slave LED total current $U_{OL}$ can be set by a user.

* * * * *